US011150019B2

(12) United States Patent
Shekhter et al.

(10) Patent No.: US 11,150,019 B2
(45) Date of Patent: Oct. 19, 2021

(54) THROUGH AIR DRYING SYSTEMS AND METHODS WITH HOT AIR INJECTION

(71) Applicant: Valmet, Inc., Biddeford, ME (US)

(72) Inventors: Mikhail Y. Shekhter, South Portland, ME (US); Dennis Edward Jewitt, Kent (GB)

(73) Assignee: Valmet, Inc., Biddeford, ME (US)

( * ) Notice: Subject to any disclaimer, the term of this patent is extended or adjusted under 35 U.S.C. 154(b) by 0 days.

(21) Appl. No.: 16/898,487

(22) Filed: Jun. 11, 2020

(65) Prior Publication Data

US 2020/0300544 A1 Sep. 24, 2020

Related U.S. Application Data

(62) Division of application No. 16/253,830, filed on Jan. 22, 2019, now Pat. No. 10,712,090.

(60) Provisional application No. 62/665,120, filed on May 1, 2018.

(51) Int. Cl.

| | |
|---|---|
| ***F26B 21/04*** | (2006.01) |
| ***F26B 3/04*** | (2006.01) |
| ***F26B 23/02*** | (2006.01) |
| ***F26B 21/10*** | (2006.01) |
| ***F26B 21/00*** | (2006.01) |

(52) U.S. Cl.

CPC ..... *F26B 21/04* (2013.01); *F26B 3/04* (2013.01); *F26B 21/001* (2013.01); *F26B 21/10* (2013.01); *F26B 23/02* (2013.01)

(58) Field of Classification Search

CPC ..... F26B 21/04; F26B 3/04; F26B 21/001; F26B 21/10; F26B 23/02

USPC ..... 34/219

See application file for complete search history.

(56) References Cited

U.S. PATENT DOCUMENTS

| | | | | | |
|---|---|---|---|---|---|
| 3,303,576 | A ‡ | 2/1967 | James | D21F 5/00 | 34/115 |
| 4,096,643 | A ‡ | 6/1978 | Futcher | D21F 5/18 | 34/114 |
| 4,247,990 | A ‡ | 2/1981 | Ohls | D21F 5/182 | 34/452 |
| 4,502,228 | A * | 3/1985 | Helbig | F26B 21/06 | 118/68 |
| 4,942,675 | A ‡ | 7/1990 | Sundgvist | D21F 5/00 | 34/122 |
| 5,416,979 | A ‡ | 5/1995 | Joiner | D21F 5/044 | 34/114 |

(Continued)

FOREIGN PATENT DOCUMENTS

| | | | | |
|---|---|---|---|---|
| CA | 2223308 C | ‡ | 3/2010 | D21F 5/04 |
| CA | 2223308 C | | 3/2010 | |

(Continued)

*Primary Examiner* — Stephen M Gravini

(74) *Attorney, Agent, or Firm* — Pierce Atwood LLP; Kevin M. Farrell; Christopher A. Baxter

(57) ABSTRACT

Systems and methods for drying or bonding materials are described. A material to be dried or bonded may be passed through a through air dryer (TAD) (or other dryer). Some of the air output by a TAD may be recirculated to be passed back through material. As the air is recirculated, it is heated and mixed to a desired temperature for drying or bonding. A separate hot air injection system may heat ambient air and/or air exhausted by the TAD and inject the heated air into the recirculated air.

10 Claims, 3 Drawing Sheets

(56) References Cited

U.S. PATENT DOCUMENTS 5,465,504 A ‡ 11/1995 Joiner ..... D21F 5/044 34/111
5,966,835 A ‡ 10/1999 Bakalar ..... D21F 5/002 34/119
6,154,981 A ‡ 12/2000 Heikkila ..... D21F 5/044 34/114
6,210,268 B1 ‡ 4/2001 Fleissner ..... F24F 13/04 34/122
6,314,659 B1 ‡ 11/2001 Parker ..... D21F 1/30 34/114
6,383,391 B1 * 5/2002 Ehrenberg ..... B01D 61/36 210/640
6,869,506 B2 * 3/2005 Jewitt ..... D21F 5/20 162/189
7,690,131 B2 ‡ 4/2010 Mausser ..... D21F 5/021 162/358.1
7,716,850 B2 ‡ 5/2010 Deem ..... D21F 5/181 162/359.1
7,861,437 B2 ‡ 1/2011 Solomon-Gunn et al. ..... F26B 23/02 34/629
7,926,200 B2 ‡ 4/2011 Lenoir ..... F26B 13/10 162/111
8,132,338 B2 ‡ 3/2012 Deem ..... D21F 5/181 162/198
10,345,041 B2 ‡ 7/2019 Oota ..... F26B 13/18
10,712,090 B2 * 7/2020 Shekhter ..... F26B 21/12
2004/0118009 A1 ‡ 6/2004 Parent ..... D21F 11/145 34/446
2004/0143993 A1 ‡ 7/2004 Almi et al. ..... D21F 5/18 34/451
2005/0251976 A1 ‡ 11/2005 Lipponen et al. ..... D21G 1/006 28/100
2007/0199202 A1 ‡ 8/2007 Solomon-Gunn et al. ..... F26B 23/02 34/403
2008/0034606 A1 ‡ 2/2008 Deem et al. ..... D21F 5/044 34/115
2019/0339009 A1 ‡ 11/2019 Shekhter ..... F26B 23/02

FOREIGN PATENT DOCUMENTS

CA 2586787 C * 1/2014 ..... D21F 5/181
DE 10 2012 010 776 ‡ 12/2012
DE 102012010776 12/2012
GB 1311364 A ‡ 3/1973 ..... F26B 13/10
GB 1311364 A 3/1973
WO 9639604 A1 12/1996
WO WO-9639604 A1 ‡ 12/1996 ..... D21F 5/022
WO 2005116332 A1 12/2005
WO WO-2005116332 A1 ‡ 12/2005 ..... D21F 11/006
WO 2019212612 A1 11/2019
WO WO-2019212612 A1 * 11/2019 ..... F26B 21/10

* cited by examiner
‡ imported from a related application

THROUGH AIR DRYING SYSTEMS AND METHODS WITH HOT AIR INJECTION

BACKGROUND

"Through air technology" is a term used to describe systems and methods enabling the flow of heated air through a nonwoven web for the purpose of drying or bonding fibers or filaments. Examples include the drying of nonwoven products (e.g., tea bags and specialty papers); drying and curing of fiberglass mat, filter paper, and resin-treated nonwovens; thermobonding and drying of spunbonded nonwovens; drying hydroentangled webs; thermobonding geotextiles with or without bicomponent fibers; drying and curing interlining grades; and thermobonding absorbent cores with fusible binder fibers. The drying of tissue paper is a particularly important application of through air technology and systems and methods related to through air drying are commonly referred to through the use of the "TAD" acronym. Certain through air systems use natural gas burners to deliver heat energy to the system. That is, in order to expose material to air of a temperature that can dry or bond the material, the through air system may use natural gas burners to heat the air.

SUMMARY

As discussed above in the Background section, TAD systems represent an important species of the broader genus of through air technology systems. The invention disclosed herein is applicable to the genus of through air technology systems and methods but, for simplicity, the invention may be discussed herein in the context of TAD systems and methods. A significant challenge relating to TAD systems is the introduction of large quantities of energy (e.g., 20 to 60 MW) into a TAD system without compromising performance, controllability, and reliability, enlargement of the TAD system, pressure drop, air mixing, turndown, and achieving target air temperature to a TAD from commonly used heat exchange devices.

The present disclosure provides TAD systems with reduced carbon footprints. TAD systems according to the present disclosure mitigate climate change related to use of fossil fuels. A TAD system may use alternative energy sources or other carbon neutral sources, such as hydro power, biofuels, solar, wind, heat recovery, steam/condensate heat exchange, etc.

A TAD system according to the present disclosure has several advantages, including: staged energy input from various heat sources and heat exchange devices; a reduced carbon footprint; an independent energy delivery system that allows operation of the TAD system in a conventional mode with natural gas burners as backup; an ability to recover low grade heat from TAD exhaust; an ability to modulate energy input from several preferred sources including burners or electric heat exchangers; an ease of maintenance including accessibility (e.g., isolation of a hot air injection system from the TAD system allows maintenance on the hot air injection system to be performed while the TAD system is in operation); temperature and flow uniformity in TAD supply is maintained; multiple energy sources can be used to take advantage of temperature ranges best suited to the various sources (e.g. heat recovery from TAD exhaust, steam, condensate, hot oil, electric, and other streams); the ability to add additional heat sources and heat exchangers without TAD system re-design or rebuild (e.g., hot air injection system components can be supplemented in series with already installed TAD system components); the ability to retrofit into an existing TAD system; and the ability to use exhaust vacuum discharge as a make-up into the hot air injection system According to the present disclosure, a hot air injection system using alternative energy sources, including carbon neutral sources, is configured to deliver hot air to one or more TAD systems. A TAD system according to the present disclosure may include a burner system than can be used whether or not the hot air injection system is in operation.

Certain aspects of a TAD system according to the present disclosure may operate according to TAD system operations presently known. For example, the temperature of the air input to a hood of the TAD and the flow rate of the air in the hood may be modulated using known fan speeds and burner outputs. By injecting air from a hot air injection system into a TAD system airflow, as described herein, burner energy needed to heat air to a desired temperature may be reduced and fan speeds may be altered as compared to known techniques.

A hot air injection system may be in operation with a burner at a low fire output in which the burner retains responsibility of controlling a drying temperature. A hot air injection system may alternatively not operate, resulting in the TAD system operating in a traditional mode of independent operation.

A hot air injection system according to the present disclosure may provide a full degree of flexibility when used with a TAD system(s). The TAD system(s) may be utilized independently from or together with the hot air injection system. Such configuration allows for complete isolation of the different air systems, which in turn allows for access, maintenance, start-up, and shutdown independently from each other. In addition, such system configuration allows for seamless transition between conventional operation without hot air injection and operation with hot air injection without jeopardizing production (e.g., drying of material).

An aspect of the present disclosure relates to a system for drying (or bonding) material. The system includes a first air stream configured by a combustion heater, a mixing element, a hood, and a foraminous cylinder. The combustion heater is configured to produce first heated air. The mixing element operates on the first heated air to produce second heated air of a desired temperature. An example of a mixing element suitable for use in connection with the present disclosure is described in U.S. Pat. No. 7,861,437, the disclosure of which is incorporated herein by reference in its entirety. The hood receives the second heated air. The foraminous cylinder is surrounded by the hood and outputs cooled air. The system also includes a second air stream configured with at least one heating element and at least one fan in fluidic communication with the at least one heating element. The at least one heating element is configured to produce third heated air. The at least one fan causes the third heated air to be injected into the first air stream. The combustion heater operates on the third heated air and at least a portion of the cooled air to produce the first heated air.

Another aspect of the present disclosure relates to a method for drying material. The method includes producing cooled air, producing first heated air using at least one heating element, combining at least a portion of the cooled air and the first heated air to produce mixed air, heating the mixed air using a combustion heater to produce second heated air, mixing the second heated air to produce third heated air of a desired temperature, and exposing the third heated air to the material to produce the cooled air.

While the present disclosure is described with respect to through air systems including dryers and bonders, other systems may be used, such as Yankee air systems, flatbed dryers, floater dryers, and other dryers and ovens.

BRIEF DESCRIPTION OF DRAWINGS

For a more complete understanding of the present disclosure, reference is now made to the following description taken in conjunction with the accompanying drawings.

DETAILED DESCRIPTION

Figure 1:
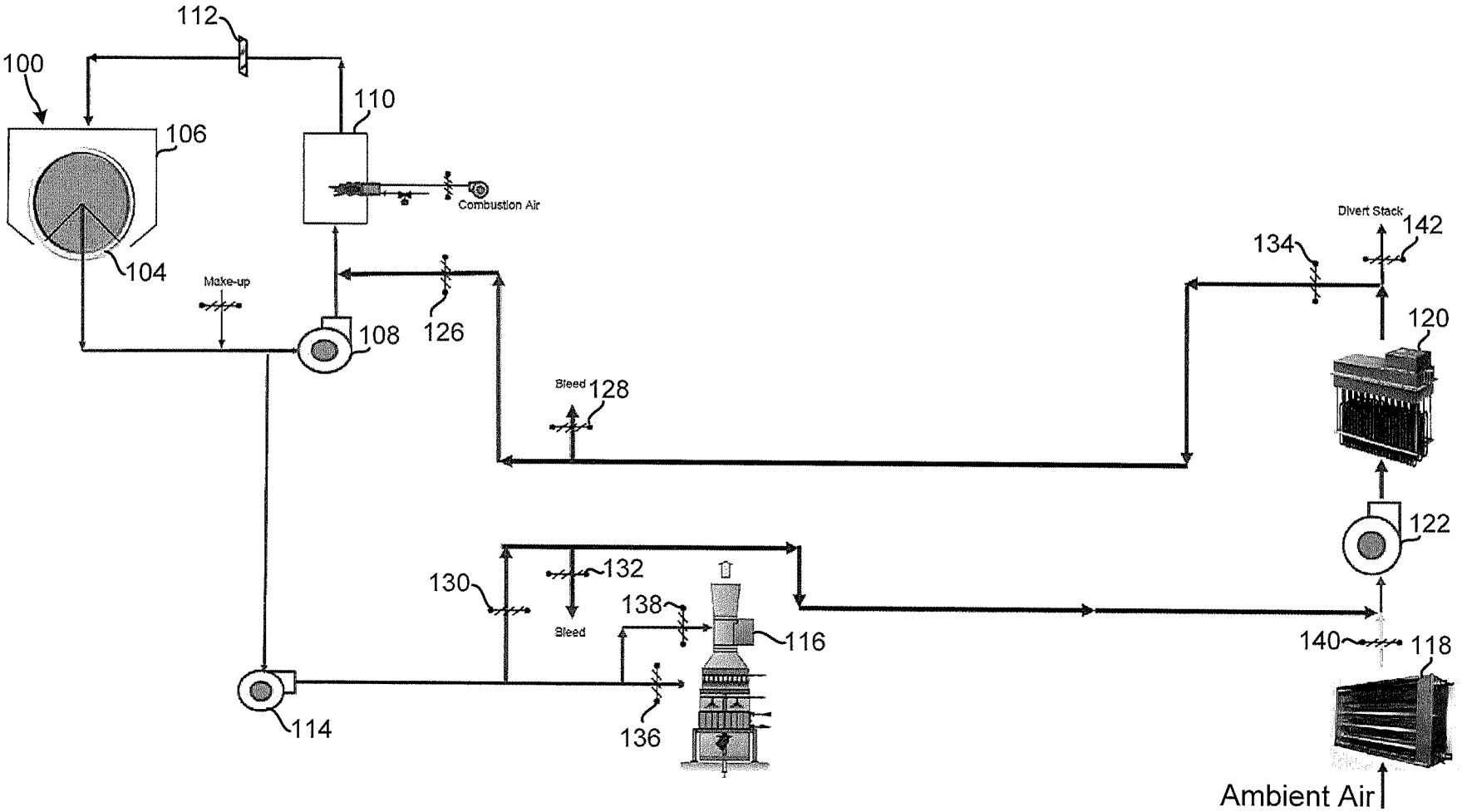
FIG. 1 is a schematic diagram of a single TAD system with a hot air injection system according to embodiments of the present disclosure.

The present disclosure includes at least one TAD system coupled to a hot air injection system to, for example, reduce carbon emission and deliver required energy to evaporate water for a paper web like tissue paper or other similar products like nonwoven materials. A hot air injection system may provide (e.g., inject) hot air to the TAD system(s) at a suitably elevated temperature to increase the temperature of air, output by a TAD(s) of the system's/systems', to a desired supply air drying temperature. The desired supply air may be supplied to material in the TAD(s) to be dried. An air flow of cooled air output from a TAD, circulated through components to heat the cooled air to a desired temperature, and the insertion of the air of the desired temperature into the TAD may be referred to herein as "recirculated air" or "recirculating air."

A traditional TAD system design may remain mostly unaffected by inclusion of a hot air injection system according to the present disclosure. The hot air injection system may be introduced into a TAD system in a manner to mix with the TAD system's recirculating air. Mixing of the TAD system's recirculating air and air supplied by the hot air injection system may occur before or after a main recirculating fan of the TAD system. Mixing of the TAD system's recirculating air and air supplied by the hot air injection system may also occur before or after an air heater section of the TAD system. For example, the hot air injection system may inject heated air into the TAD system's recirculating air upstream of a combustion heater(s) with respect to a flow of the recirculated air. For further example, the hot air injection system may inject heated air into the TAD system's recirculating air downstream of a combustion heater(s) with respect to a flow of the recirculated air. In a preferred implementation, ml×mg of the TAD system's recirculating air and air supplied by the hot air injection system may occur between the main fan and air heater section of the TAD system.

The hot air injection system may be implemented apart from the TAD system such that the TAD system can operate without the hot air injection system in operation. This enables the TAD system to remain in operation while maintenance is performed on the hot air injection system and/or due to unplanned downtime of the hot air injection system.

Multiple heat sources may be used to heat air input to the hot air injection system. The air input to the hot air injection system may come from ambient air (e.g., fresh air from the hot air system's surroundings), TAD system exhaust, and/or other sources. Air input to the hot air injection system may originate from a single source (e.g., only ambient air or only TAD system exhaust) or may be a combination of air from multiple sources (e.g., a combination of ambient air and TAD system exhaust).

A fan may be used to draw air entering the hot air injection system either before or after any combination of heat exchangers or introduction of other air sources. Air is progressively heated to the desired injection temperature through a combination of heat sources and heat exchangers. One arrangement includes TAD system exhaust air mixed with preheated ambient air which then proceeds through a fan, then through a steam heat exchanger, an oil heat exchanger, and an electric heat exchange (or banks of exchangers). The foregoing arrangement is illustrative. Thus, one skilled in the art will appreciate that other arrangements for heating air in the hot air injection system may be used. An objective of the sequence of heating elements in the hot air injection system may be to elevate the air's temperature step-wise, taking advantage of a maximum (e.g., optimum) temperature output of each heating element. For example, a steam heat exchanger may heat air to about 182° C., an oil heat exchanger may heat the about 182° C. air to about 290° C., and an electric heat exchanger may heat the about 290° C. air to about 450° C. or above.

Figure 2:
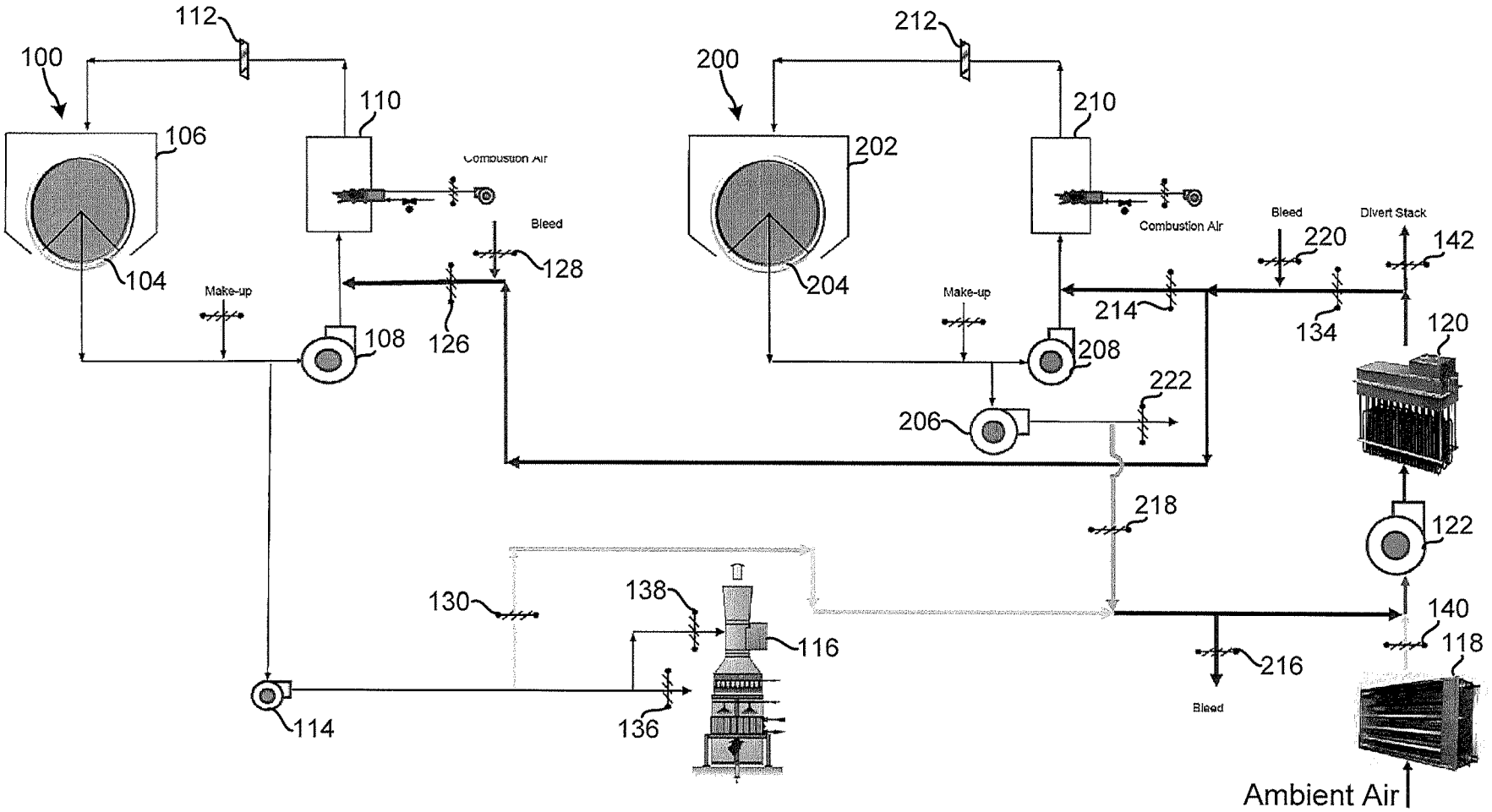
FIG. 2 is a schematic diagram of a two TAD system with a hot air injection system according to embodiments of the present disclosure.

FIG. 1 illustrates an example configuration of a single TAD system with a hot air injection system. The lines illustrated in FIGS. 1 and 2 represent possible airflows of systems according to the present disclosure.

The TAD system may include a TAD 100 including a foraminous (e.g., porous) cylinder 104 at least partially surrounded by a hood 106, a main fan(s) 108, an air heater(s) 110, and a mixer(s) 112. While only one main fan 108, one air heater 110, and one mixer 112 are illustrated, one skilled in the art will appreciate that the TAD system may include more than one main fan 108, more than one air heater 110, and/or more than one mixer 112.

Material to be dried is carried along the foraminous cylinder 104 through the hood 106. Heated air of a desired temperature is input to the hood 106 and exposed to the material to be dried. Air that travels through the material, thereby drying the material, is cooler than it was when it first contacted the material. The cooled air that traveled through the material thereafter travels through holes in the foraminous cylinder 104 and is output from the TAD 100 as cooled (or exhaust) air.

Some of the cooled air output from the TAD 100 may be recirculated to the TAD 100. As illustrated, some of the cooled air that is output from the TAD 100 may be passed through the main fan 108 to the air heater 110. The air heater 110 may heat the cooled air via combustion of fossil fuels. The air heater 110 heats the cooled air and outputs the heated air to the mixer 112. The air heater 110 may include various types of air heating elements known in the art and not yet created. For example, the air heater 110 may include one or more electric heaters, one or more steam coils, one or more glycol/air heat exchangers, and/or one or more combustion-based heating elements. The air heating element(s) implemented in the air heater 110 may depend on system configuration and a desired temperature of the air to be output by the air heater 110. The mixer 112 receives heated air from the air heater 110 and outputs heated air of the desired temperature that is input to the TAD 100 (and more particular to the hood 106).

Some of the cooled air output from the TAD 100 may be output from the TAD system, to the hot air injection system, due to operation of an exhaust fan 114. Some of the cooled air output from the TAD 100 may be input to an air-to-glycol heat exchanger 116, where the cooled air (being cooled with respect to the air input to the TAD 110 but not cooled to the point of being ambient) heats glycol of the air-to-glycol heat exchanger 116. After heating the glycol, the air may be output to an environment of the system via a tower of the air-to-glycol heat exchanger 116. This output air may be relatively cold and at saturated condition (e.g., 100% relative humidity). Such output of air enables the system to remove evaporated water using the air and also enables the system to maintain an air system balance.

The hot air injection system may include one or more air heating elements. For example, the hot air injection system may include a glycol-to-air heat exchanger(s) 118 and an electric heater 120. Coils of the glycol-to-air heat exchanger(s) 118 may receive heated glycol from the air-to-glycol heat exchanger 116 (e.g., the glycol heated by the cooled air output by the TAD 100 and passed through the exhaust fan 114). The hot air injection system may also include one or more other heating elements, such as steam coils, other heating elements known in the art, and heating elements not yet created.

The heating elements of the hot air injection system may be arranged and configured to elevate the air's temperature step-wise, taking advantage of a maximum (e.g., optimum) temperature output of each heating element. For example, air in the hot air injection system may first be exposed to a steam heat exchanger that may heat the air to about 182° C. The about 182° C. air may be exposed to an oil heat exchanger that may further heat the air to about 290° C. The about 290° C. air may be exposed to an electric heat exchanger that may further heat the air to about 450° C. or above. The foregoing arrangement of heating elements is merely illustrative. As such, one skilled in the art will appreciate that the amount, kinds, and arrangements of the heating elements of the hot air injection system may depend on system configuration and a desired temperature of the air to be output by the hot air injection system.

The hot air injection system may also include a fan 122 that causes air in the hot air injection system to be injected into the TAD system. The fan 122 may be located upstream (with respect to airflow) of all heating elements of the hot air injection system, between heating elements of the hot air injection system (as illustrated), or downstream (with respect to airflow) of all heating elements of the hot air injection system.

In one example, the air input to the hot air injection system may be purely ambient air received from the hot air injection system's surroundings. This may be achieved by closing a damper 130 and opening a damper 140. In another example, the air input to the hot air injection system may be purely cooled air output from the TAD system, which optionally passes through the exhaust fan 114 prior to being input to the hot air injection system. This may be achieved by closing the damper 140 and opening the damper 130. In a further example, the air input to the hot air injection system may be a combination of ambient air of the hot air injection system's surroundings and cooled air output by the TAD system. This may be achieved by opening various dampers (130/140). The proportionality of the combined ambient and cooled airs input to the air injection system may depend on various factors, including system configuration (e.g., the amount each damper is opened or closed), air speeds, a desired temperature of the air to be output by the hot air injection system, as well as other considerations.

The TAD 100, main fan 108, air heater 110, and mixer 112, and the ducting coupling the foregoing components together, may form a first air stream. The heating elements of the hot air injection system and the fan 122 may form a second air stream, different from the first air stream.

The heated air generated by the heating elements of the hot air injection system may be injected (by use of the fan 122 and opening of dampers 126/134) into the first air stream of the TAD system. The heated air generated by the hot air injection system may be injected into the TAD system's airflow at different locations based on system configuration and requirements. For example, the heated air generated by the hot air injection system may be injected into the TAD system's airflow between the main fan 108 and the air heater 110, (as illustrated), between the air heater 110 and the mixer 112, or another desired location.

FIG. 2 illustrates an example configuration of a two TAD system with a hot air injection system. A first TAD system includes the TAD 100 including the foraminous cylinder 104 at least partially surrounded by the hood 106, the main fan(s) 108, the air heater(s) 110, and the mixer(s) 112. A second TAD system includes a TAD 200 including a foraminous cylinder 204, at least partially surrounded by a hood 202, a main fan(s) 208, an air heater(s) 210, and a mixer(s) 212. While only one main fan 208, one air heater 210, and one mixer 212 are illustrated, one skilled in the art will appreciate that the TAD system may include more than one main fan 208, more than one air heater 210, and/or more than one mixer 212. Materials are dried by the first TAD 100 and the second TAD 200 as described above with respect to FIG. 1.

Like FIG. 1, the system of FIG. 2 is configured to have some of the cooled air output from the TAD 100 to be recirculated to the TAD 100. In addition, some of the cooled air output from the TAD 100 may be output from the TAD system as exhaust. Such air may be input to the hot air injection system via the exhaust fan 114.

The same is true for the TAD 200 in that some air output from the TAD 200 may be recirculated to the TAD 200 (after the air is recirculated through the main fan 208, air heater 210, and mixer 212) and some cooled air may be input to the hot air injection system via an exhaust fan 206. In an example, the exhaust fan 206 injects air from the TAD 200 into an air stream located between the exhaust fan 114 and air-to-glycol heat exchanger 116, and the hot air injection system.

The system may be configured such that hot air output from the hot air injection system may be input to both the TADs (100/200) (e.g., when dampers 134, 214, and 126 are open, and damper 142 is closed), one of the TADs (100/200) (e.g., when dampers 134 and 214 are opened and dampers 126 and 142 are closed, or when dampers 126 and 134 are opened and dampers 214 and 142 are closed), or neither of the TADs (100/200) (e.g., when at least dampers 126 and 214 are closed, and damper 142 is open). Determinations of how to route hot air output by the hot air injection system may depend on maintenance considerations, desired temperatures of air to be inserted into the TADs (e.g., certain materials may be effectively dried at reduced temperatures compared to other materials, making it unnecessary to inject hot air from the hot air injection system into the TAD air stream in that use case), as well as other considerations.

Figure 3:
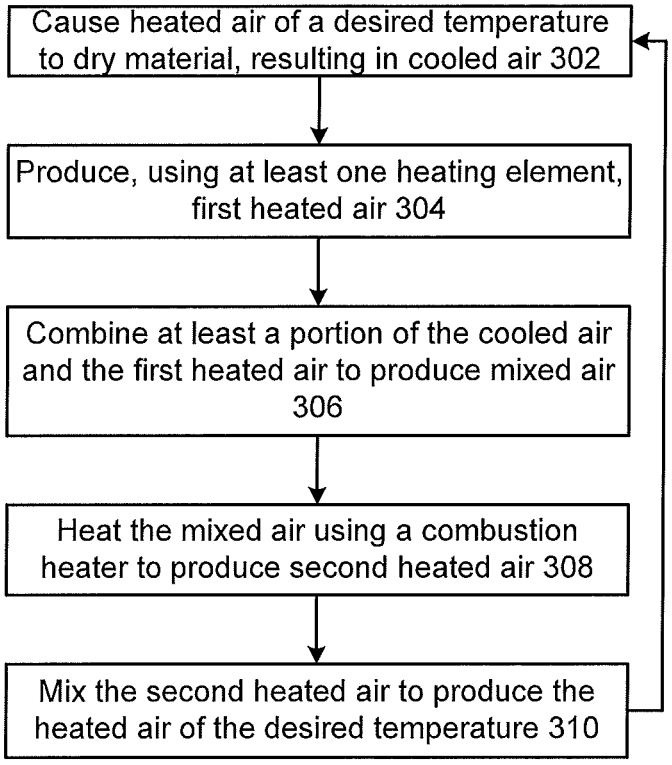
FIG. 3 is a process flow diagram illustrating operation of a single TAD system with a hot air injection system according to embodiments of the present disclosure.

FIG. 3 illustrates operations performed by a single TAD system with a hot air injection system. Heated air of a desired temperature is directed into the hood 106 of the TAD 100 to cause (302) the heated air of the desired temperature to dry material on the foraminous cylinder 104, resulting in the heated air of the desired temperature becoming cooled air.

The at least one heating element of the hot air injection system (e.g., the glycol-to-air heat exchanger 118 and/or the electric heater 120) produces (304) first heated air from ambient air, some or all of the cooled air output by the TAD 100, or a combination of ambient air and some or all of the cooled air output by the TAD 100.

The hot air injection system injects the first heated air into the air stream of the of the TAD system. In an example, the first heated air is combined (306) with at least a portion of the cooled air output by the TAD 100, resulting in mixed air. In this implementation, the air heater 110 heats (308) the mixed air using combustion to produce second heated air. The second heated air is then operated on by the mixer 112 to mix (310) the second heated air into the heated air of the desired temperature that is used to dry material.

The processes described with respect to FIG. 3 may be performed by a two TAD system as illustrated in FIG. 2. Moreover, while the above describes steps of the method in a particular order, one skilled in the art will appreciate that the steps may be performed in a different order, and/or some of the steps may be removed or omitted, without departing from the present disclosure.

Since the hot air injection system is physically coupled to the TAD system(s), there is a potential for flammable gases to penetrate the hot air injection system while the TAD system(s) is in operation. Thus, prior to starting the hot air injection system, a pre-ignition purge may be performed to evacuate at least four air volumes according to NFPA-86. The TAD system(s) may include modified controls to ensure the pre-ignition purge includes additional interlocks to verify there are no flammable gases that can enter the TAD system(s) from the hot air injection system. Complete separation of the TAD system(s) and the hot air injection system may be achieved using a double block and bleed arrangement using multiple isolation and bleed-off dampers.

Pre-ignition purge of the hot air injection system may be controlled by a dedicated hot air injection control system or a mill distributed control system (DCS). The control system ensures the hot air injection system is isolated from the TAD system(s), all hot air injection ducts are purged, ambient air is available to enter the hot air injection system, and the pre-ignition purge airflow is measured and verified. Movement of air in the hot air injection system during the pre-ignition purge may be facilitated by the fan 122 and the airflow may be proven using flow meters.

The hot air injection system may be started after the pre-ignition purge is completed and once the TAD system(s) is in operation and at steady state conditions. To turn on the hot air injection system, all bleed-off dampers of the hot air injection system (e.g., 128/132 and 216/220 depending on system configuration) may be closed, resulting in a single pass through airflow being established from the glycol-to-air heat exchanger 118 to a divert stack. Once the single pass through airflow is established, the electric heater 120 may be started to a desired operation, resulting in the temperature of the air output by the electric heater 120 (and by extension the hot air injection system) remaining constant (or relatively constant) thereafter.

Dampers (126 and 214 depending on system configuration), located at connections between ducting of the hot air injection system and ducting of the TAD system(s), may be opened to permit heated air to be injected from the hot air injection system into the TAD system(s) airflow(s). At the same time (or substantially the same time), a damper(s) 142 of the divert stack of the hot air injection system may be closed. Upon injection of the heated air of the hot air injection system into the TAD system(s) airflow(s), cooled air (e.g., exhaust air) of the TAD system(s) may be introduced into the hot air injection system to recover TAD system(s) exhaust air energy.

The hot air injection system is flexible in that it allows for a variable combination of ambient air and TAD system(s) cooled air(s) to be input therein. For example, in a two TAD system configuration, one or more dampers may be opened to only permit the first TAD's cooled air to be input to the hot air injection system, one or more dampers may be opened to only permit the second TAD's cooled air to be input to the hot air injection system, or one or more dampers may be opened to permit cooled airs of both of the TADs to be input to the hot air injection system. When the dampers are opened to permit cooled airs of both of the TADs to be input to the hot air injection system, the dampers may be opened to permit more of the first TAD's cooled air to be input to the hot air injection system than the second TAD's cooled air, permit more of the second TAD's cooled air to be input to the hot air injection system than the first TAD's cooled air, or permit equal amounts of the first and second TAD's cooled airs to be input to the hot air injection system. The cooled air of the TAD(s) system(s) may be input to the hot air injection system downstream from the glycol-to-air heat exchanger 118 with respect to airflow of the hot air injection system, but upstream from the electric heater 120. More preferably, the cooled air of the TAD(s) system(s) may be input to the hot air injection system downstream from the glycol-to-air heat exchanger 118 with respect to airflow of the hot air injection system, but upstream from the electric heater 120 and the fan 122.

Once the hot air injection system air is injected into the TAD system(s) airflow(s), the heating performed by the air heater(s) (110/210) and the speed of the main fan(s) (108/208) may be adjusted to maintain the temperature of the air(s) in the hood(s) (106/202) at a desired temperature(s) (e.g., the temperature experienced in the hood(s) 106/202 prior to the air being injected by the hot air injection system). It will thus be appreciated that injection of hot air by the hot air injection system may decrease the amount of heating needed to be performed by the air heater(s) (110/210). In implementations where the air heater(s) (110/210) operates by combustion of fossil fuels, such a configuration may result in decreased use of fossil fuels.

A TAD system may experience a stock off condition where material to be dried (and/or that is already dried) is rapidly taken off the TAD system. It is important to quickly reduce the temperature of the air input to the hood of the TAD system to safe limits to avoid TAD fabric thermal damage. TAD fabric refers to a fabric used to transport material to be dried (and/or that is already dried) through the system.

Upon the TAD system generating a stock off signal, the TAD control system may close the hot air injection system damper(s) (126 and 214 depending on system configuration) and open the damper(s) 142 of the divert stack. This manages the temperature of the hot air injection system's air and electric heater 120 load changed during abrupt stock off conditions. Once a stock on is initiated and the TAD system is exhibiting steady state conditions, the hot air injection system air can be introduced into the TAD system (e.g., by opening one or more dampers (128/214) and closing the damper(s) 142 of the divert stack).

When a machine e-stop command is received, the hot air injection system components may be forced into a safe state.

This may include shutting off power to the electric heater 120, stopping the fan 122, closing all isolation dampers (e.g., 126/130/134/136/214/218) of the hot air injection system, opening the damper(s) 142 of the divert stack, and/or opening all bleed-off dampers (e.g., 128/132/216/220) of the hot air injection system. The foregoing damper configurations ensure there is enough natural draft through the hot air injection system to prevent the electric heater 120 from over-heating.

The hot air injection system may be shutdown independently from the TAD system(s). A sequence for shutting down the hot air injection system may include opening the damper(s) 142 of the divert stack, closing all isolation dampers (e.g., 126/130/134/136/214/218) of the hot air injection system, opening all bleed-off dampers (e.g., 128/132/216/220) of the hot air injection system, and/or gradually decreasing the power input to the electric heater 120 to zero (e.g., according to a programmed ramp). The speed of the fan 122 may also be gradually reduced (e.g., ramped) until the fan 122 is stopped.

While the present disclosure has been particularly described in conjunction with specific embodiments, it is evident that many alternatives, modifications, and variations will be apparent to those skilled in the art in light of the foregoing description. It is therefore contemplated that the appended claims will embrace any such alternatives, modifications, and variations as falling within the true spirit and scope of the present disclosure.

What is claimed is:

1. A method for drying or bonding material, comprising:

directing, into a hood of a through air dryer (TAD), a heated air to dry a material on a foraminous cylinder, wherein the heated air becomes a cooled air as it passes through the material and the foraminous cylinder;

producing a first heated air by heating a first air using at least a first heating element;

combining the first heated air with at least a first portion of the cooled air exhausted from the foraminous cylinder, resulting in mixed air;

heating the mixed air using at least a second heating element to produce a second heated air; and mixing the second heated air to produce the heated air.

2. The method of claim 1, further comprising:

producing the first heated air by heating an ambient air using the at least first heating element.

3. The method of claim 1, further comprising:

inputting at least a second portion of the cooled air into the at least first heating element.

4. The method of claim 1, further comprising:

producing the first heated air by passing an ambient air through a glycol-to-air heat exchanger.

5. The method of claim 1, further comprising:

producing the first heated air by inputting, to the at least first heating element, a combination of an ambient air and a second portion of the cooled air.

6. The method of claim 1, further comprising:

producing a second cooled air;

producing a third heated air using at least a third heating element;

mixing the third heated air to produce a fourth heated air of a desired temperature; and exposing the fourth heated air to a second material to produce the second cooled air.

7. The method of claim 6, further comprising:

inputting, to the at least first heating element, a combination of a second portion of the cooled air and at least a portion of the second cooled air.

8. The method of claim 4, further comprising:

heating, using a second portion of the cooled air, glycol of an air-to-glycol heat exchanger; and supplying, after heating the glycol, the glycol to coils of the glycol-to-air heat exchanger.

9. The method of claim 1, further comprising:

passing an ambient air through a glycol-to-air heat exchanger to produce an intermediate heated air; and passing the intermediate heated air through an electric heater to produce the first heated air.

10. The method of claim 1, wherein:

combining the first heated air with the at least first portion of the cooled air reduces an amount of combustion needed to be performed by the at least second heating element.

* * * * *